US006259794B1

(12) United States Patent
Dobbins

(10) Patent No.: US 6,259,794 B1
(45) Date of Patent: Jul. 10, 2001

(54) AUDIO DEVICE FOR MEDICATION CONTAINER

(75) Inventor: John C. Dobbins, Southington, CT (US)

(73) Assignee: Millennium Compliance, Southington, CT (US)

( * ) Notice: Subject to any disclaimer, the term of this patent is extended or adjusted under 35 U.S.C. 154(b) by 0 days.

(21) Appl. No.: 09/399,671

(22) Filed: Sep. 21, 1999

(51) Int. Cl.[7] ..... G07F 11/00

(52) U.S. Cl. ..... 381/124; 704/272; 221/3; 215/400

(58) Field of Search ..... 381/61, 124, 386, 381/334, 118; 700/94; 704/270, 272, 271, 278; 215/273, 291, 336, 400; 221/2, 3; 340/391.1, 825.35

(56) References Cited

U.S. PATENT DOCUMENTS 4,361,408 * 11/1982 Wirtschafter ..... 368/10
4,801,929 * 1/1989 Instance ..... 340/692
4,926,572 * 5/1990 Holmes ..... 368/10
5,011,032 4/1991 Rollman .
5,536,196 * 7/1996 Sternberg ..... 215/400
5,577,918 * 11/1996 Crowell ..... 343/319
5,724,021 * 3/1998 Perrone ..... 221/3
5,812,064 * 9/1998 Barbour ..... 340/825.35
5,815,586 9/1998 Dobbins ..... 381/124
5,835,455 * 11/1998 Hanson et al. ..... 368/10
5,852,803 * 12/1998 Ashby, III et al. ..... 704/272
5,890,121 3/1999 Borcherding .

OTHER PUBLICATIONS

International Search Report Jul. 24, 2000 PCT.

* cited by examiner

*Primary Examiner*—Xu Mei
(74) *Attorney, Agent, or Firm*—McCormick, Paulding & Huber LLP

(57) ABSTRACT

An audio device for a capped medication container to record and playback medication instructions has a housing which carrier a power supply, an input component (i.e., microphone or input jack), an audio output component (speaker), an electronic data and operating memory, and operating control buttons and may be adapted for releasable attachment to a capped upper end or a closed lower end of a medication carrier.

17 Claims, 2 Drawing Sheets

AUDIO DEVICE FOR MEDICATION CONTAINER

RELATED PATENTS

This patent application is related to U.S. Pat. No. 5,815,586, which is incorporated herein by reference.

TECHNICAL FIELD

The present invention relates to medication containers and, more particularly, to a device for recording and playing back audio messages and that attaches to a medication container.

BACKGROUND OF THE INVENTION

Medication containers, particularly those for prescribed medications, require specific written instructions for a patient with regard to dosages and other special instructions to be printed on a label and affixed to the container, or to be packaged with the container. Instructions may be provided from the patient's physician, the drug manufacturer, or the distributor.

Written instructions that are provided with medications are subject to various shortcomings attributable to various factors including limited writing space, poor vision, low literacy level of the patient, primary spoken language of the patient, potential for physical damage to or smudging of written labels, and misplacing of enclosed instructions. For example, written instructions that are required to be fixed to the outside of the medication container on a label must be printed in letters large enough to be seen by the reader, yet small enough to enable the complete instructions to be printed on the label which is relatively limited in writing area. This may result in medication labels that are in print that are too small to be read by people with poor vision, without the need for magnifiers or other vision aids. In some situations it may be necessary for instructions to be written very concisely to fit on a label. This sometimes results in language being omitted for the sake of brevity thereby rendering the instructions deficient or difficult to comprehend. In other situations, where the label or instructions are written in a language that is not the native or first language of the patient, it may be difficult for the patient to understand the instructions. Labels fixed to medication containers are subject to wear, smudging, and moisture, which may result in damage to the label so that it cannot be read. Lastly, certain enclosed instructions and warnings that may have been enclosed in the manufacturer's packaging, but not printed on a label, may be misplaced or otherwise separated from the medication container.

OBJECTS AND SUMMARY OF THE PRESENT INVENTION

It is an object of the present invention to provide a device associated with a medication container for delivering instructions and warnings to patients using a medication. It is a further object to provide such a device in a manner that overcomes the shortcomings discussed above with conventional printed labels and instruction enclosures. These objects and others are achieved by the present invention as will be described herein.

The present invention is directed to a device that attaches to a medication container and has a built-in audio recording and playback feature for recording and listening to instructions. The self-contained device has a power supply, an audio input component (i.e., microphone), an audio output component (speaker), audio recording storage in the form of electronic data memory, control buttons in communication with a microprocessor, and associated electronic circuitry. In one embodiment, the device is adapted to clip onto the cap of a medication container. In another embodiment, the device is adapted to slide over the lower end of a medication container. The aforementioned embodiments of the present invention are physically adapted to enable use of a conventional medication container cap in its ordinary fashion, without interfering with safe and proper operation thereof which is strictly regulated.

In operation, a physician and/or a pharmacist can verbally instruct a patient by recording a voice message into the device of the present invention. The device is attached to a medication container. A playback feature enables the patient, upon receiving the medication container and the device of the present invention, to playback the recording to receive verbal, audio instructions and warnings. This system can be used in lieu of or in association with conventional, written instructions and warnings on a printed label or printed enclosures.

DESCRIPTION OF THE PREFERRED EMBODIMENTS

Figure 1:
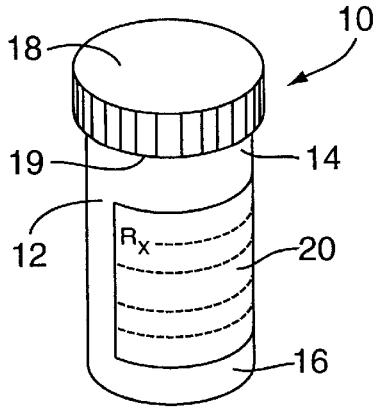
FIG. 1 is a perspective view of a conventional, cylindrical medication container having a rotatable cap and an adhesive label thereon.

A conventional medication container (10) of the type used to dispense and store prescription medication comprises a cylindrical body (12) with an open top end (14) having threads (not shown) and a closed bottom end (16) is illustrated in FIG. 1. A rotatable cap (18) is provided to engage the threads on the body (12) of the container (10) to securely close the container (10). The cap (18) has a generally radially disposed annular lower surface (19), best shown in FIGS. 1 and 10, which encircles the container body (12) when the cap is releasably retained on the body. The cap may be of the type having child-proof or safety locking configurations. An adhesive label (20) of the type ordinarily used to display written instructions, warnings and patient and physician information is applied to the body (12) of the container (10).

Figure 2:
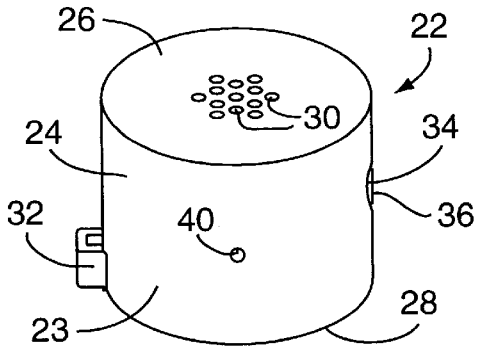
FIG. 2 is a front, top perspective view of a first embodiment of the present invention.
Figure 3:
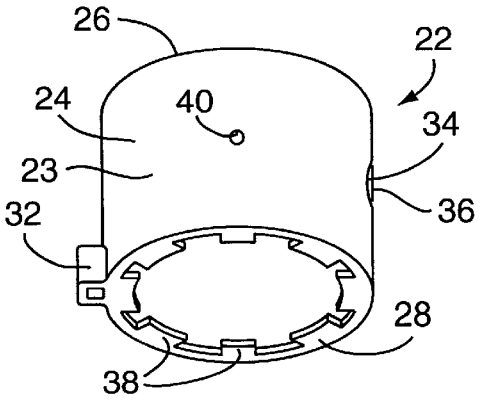
FIG. 3 is a front, bottom perspective view of the first embodiment of the present invention.

A recording and playback device (22) according to a first embodiment of the present invention is illustrated in FIGS. 2–3. The device (22) has a hollow housing (23) and includes a cylindrical wall (24), a top surface (26), and a bottom end (28) defining a generally cylindrical opening (29) sized to receive the cap (18) therethrough. A set of speaker holes (30) are provided on the top surface (26) to accommodate an internal speaker (discussed below). Optionally, the speaker holes could be positioned on the cylindrical wall (24). A safety tie hook (32) is provided on the cylindrical wall (24) to accommodate safety means (discussed below) for securing the device (22) to a medication container. The cylindrical wall (24) includes a recessed portion (34) to accommodate a playback button (36) for playing back audio messages, as will be discussed below. A series of flexible teeth (38) are formed on the inner circumferential surface of the open bottom end (28) in order to flex upon contact with a medication container cap, to surround and engage the same. A recessed microphone hole (40) is provided for receiving sounds to be recorded, as will be discussed below.

Figure 4:
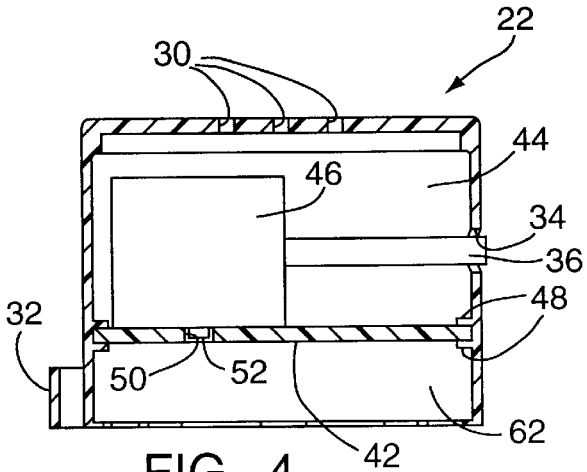
FIG. 4 is a schematic, partial, front, cross-sectional view of the first embodiment of the present invention.

Referring to FIG. 4, a schematic, cross-sectional view of the device (22) described in FIGS. 2–3 is provided. As shown, a horizontal, internal wall (42) is provided above and generally parallel to the open bottom end (28) of the device (22). The internal wall (42) is provided to serve to seal off the internal chamber (44) that houses the recording and playback components (46), shown schematically. The internal wall (42) also functions as a stop for engagement with a medication container cap to secure the cap and prevent it from damaging internal components (46). A set of internal tabs (48) can be provided to securely hold the internal wall (42) in place relative to the inner surface of the cylindrical wall (24). A record-command opening (50) is provided through the internal wall (42) to engage a recessed record button (52). The record button (52) is recessed so that it may be activated by pressing a pointed object, such as a ball point pen, into the record-command opening (50) in order to activate the record function, as discussed below, to record audible instructions.

Figure 5:
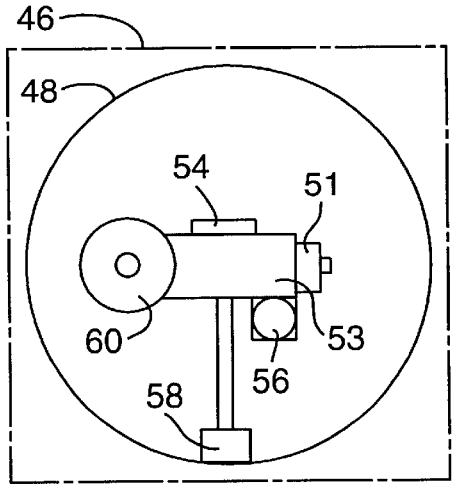
FIG. 5 is a schematic, top view of a circuit board and related components of the first embodiment of the present invention.

The internal components (46) are now illustrated schematically in FIG. 5. A circuit board (48) adapted to be securely contained in the internal chamber (44) includes a switch contact element (51) for engagement with the playback button (36). The circuit board (48) may be fixed to the internal wall (42) or otherwise fixed in the internal chamber (44). The switch contact element (51) is in communication with a microcontroller (53) which includes a data storage element (54) for storing sound data. The microcontroller (53) may comprise one or more commercially available, programmable microchips. A power source, such as a battery (56), is provided to power operation of the electrical components. A microphone (58) and speaker (60) are also provided.

In operation, the device (22) is initialized by a physician or pharmacist. The physician or pharmacist grasps the device (22) and inserts a ball point pen or other pointed object into the record command opening (50) to press the record button (52). At the same time, the physician or pharmacist speaks into the microphone hole (40) to deliver an audible message containing instructions for the medication to which the device will be attached. When the message is completed, the physician or pharmacist releases the record button (52).

Figure 6:
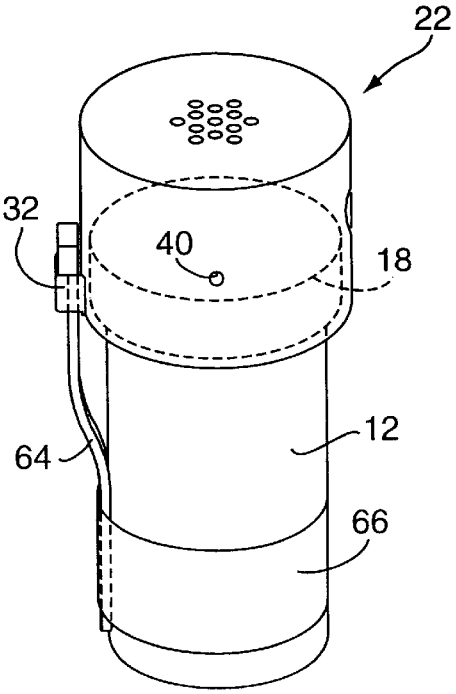
FIG. 6 is a front, top perspective view of a first embodiment of the present invention shown attached to a medication container.

The audible message is received through the microphone (58) and transformed into digital signals by the microcontroller (53) and stored. A timer may be set to control the maximum allowable length of the audible message. If desired, the device (22) may be programmed to store and selectively play more than one audible message. For example, the microcontroller (53) may be programmed to operate a calendar function or a timer and an associated alarm system to automatically emit audible signals or messages to remind a patient when it is time to take a dosage of medication. After the audible messages are stored and, if applicable, any timer or calendar functions are programmed, the device (22) is ready to be attached to a medication container as shown in FIG. 6.

The device (22) is press-fitted over the top of a medication container cap (18) by engaging the flexible teeth (38) of the bottom, open end (28) of the device (22) with the container cap (18). By applying downward force to the device (22), the flexible teeth (38) will flex and slip past the container cap (18), so that the container cap (18) resides in a secondary chamber (62) formed in the device (22) between the internal wall (42) and the flexible teeth (38). The internal wall (42) prevents the container cap (18) from penetrating into the internal chamber (44). As shown in FIG. 6, a tether (64) in the form of a flexible plastic rod or tie is attached at one end to the safety tie hook (32). The other end of the tether (64) is fixed to the medication container body (12) by adhesive tape (66) or other suitable means. The tether (64) prevents the device (22) from becoming separated from the medication container (10) when, for example, the device (22) is removed from the container cap (18) to allow the container cap (18) to be removed from the medication container (10). The housing (23) is preferably molded from a suitable plastic material, such as polyurethane, that is water-resistant and durable. If desired, the speaker (60) can be of the commercially available water-resistant type.

When a patient receives the medication container (10) having the attached device (22) according to the present invention, the patient can activate playback of the audio instructions by depressing the playback button (36). The audio message will be played by the controller (53) and associated electronic components, and emitted from the speaker holes (30).

Figure 7:
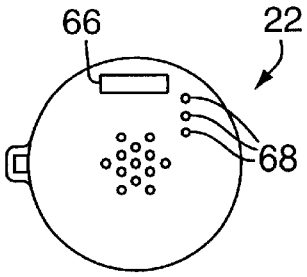
FIG. 7 is a top view of a modified component of the first embodiment of the present invention.

As shown in FIG. 7, the device (22) may include a display screen (66), such as a liquid crystal display (LCD), and programming buttons (68) for displaying and inputting information relating to programming of optional modes and functions such as a calendar, a timer and alarm, and a clock display.

Figure 9:
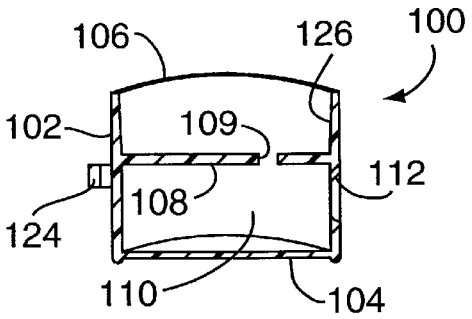
FIG. 9 is a schematic, partial, front, cross-sectional view of the second embodiment of the present invention.
Figure 8:
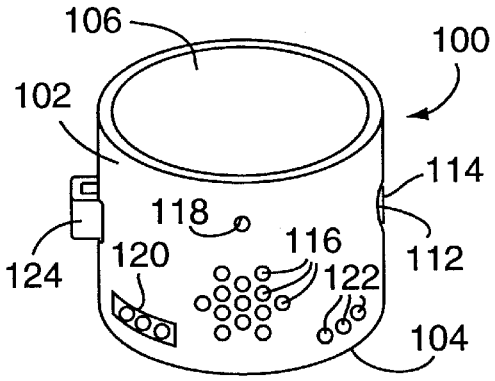
FIG. 8 is a front, top perspective view of a second embodiment of the present invention.
Figure 10:
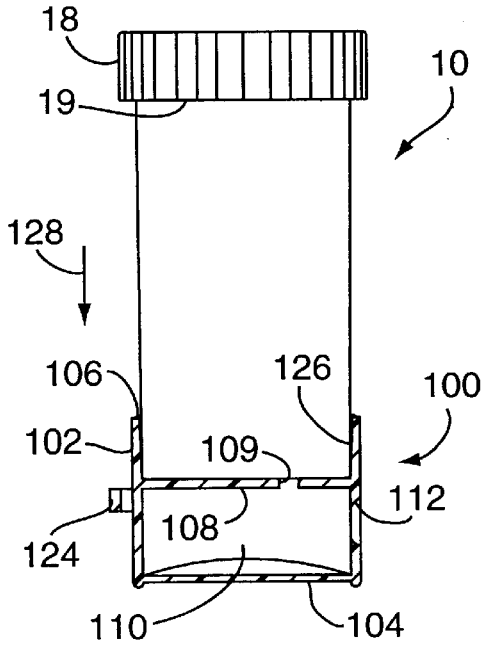
FIG. 10 is a schematic, partial, front, cross-sectional view of the second embodiment of the present invention shown with a medication container received therein.

An alternative embodiment of the present invention is illustrated in FIGS. 8–10. Referring to FIGS. 8–9, the second embodiment device (100) comprises a cylindrical wall (102), a bottom wall (104), an open top end (106), and an interior wall (108) with a record-command opening (109). An inner chamber (110) is adapted to receive a circuit board (48) having equivalent functional components as described with respect to FIG. 5. A playback button hole (112) is provided in the cylindrical wall (102) to accommodate a playback button (114). A set of speaker holes (116) is provided to accommodate an audible speaker of the type described with respect to FIG. 5. The speaker holes (116) are preferably positioned on the cylindrical wall (102), though they could be positioned on the bottom surface of the bottom wall (104). A microphone hole (118), and an optional LCD display (120) and control buttons (122) are provided on the cylindrical wall (102). However, the present invention is not limited in this regard as the display 120 and buttons 122 can be positioned in other suitable areas, such as on the bottom surface of the cylindrical wall, without departing from the broader aspects of the present invention. An optional safety tie hook (124) can be provided. The inner circumferential wall (126) decreases in diameter beginning from the top opening (106) and moving toward the interior wall (108). This provides a wedge-type fit around the bottom section of a medication container.

As illustrated in FIG. 10, a cylindrical medication container (10) is press-fitted into the device (100) in a downward direction, as shown by the arrow (128). The inner circumferential wall (126) has decreasing diameter in the downward direction such that it is slightly larger than the diameter of the medication container (10) at the top opening (106) and it is slightly smaller than the diameter of the medication container (10) at the interior wall (108). This causes the circumferential wall (126) and/or the wall of the medication container to flex slightly so that the device (100) grips the medication container (10) in a wedge-like manner with sufficient force to be retained therewith. The optional safety tie hook (124) may be tethered to the medication container (10) in a manner similar to that described with respect to FIG. 6.

Operation of the device (100) is essentially the same as described above with respect to the first embodiment device (22) of the present invention. The primary difference is that the second embodiment device (100) is generally inverted, enabling it to remain fixed to and in place with respect to the medication container (10) even when the container cap (18) is being opened or closed.

Figure 12:
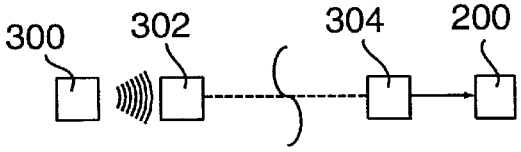
FIG. 12 is a schematic, block diagram of a fourth embodiment system according to the present invention.
Figure 11:
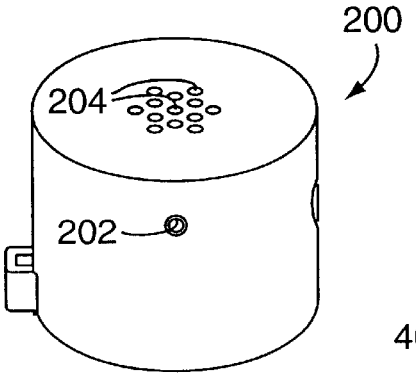
FIG. 11 is a front, top perspective view of a third embodiment of the present invention.
Figure 13:
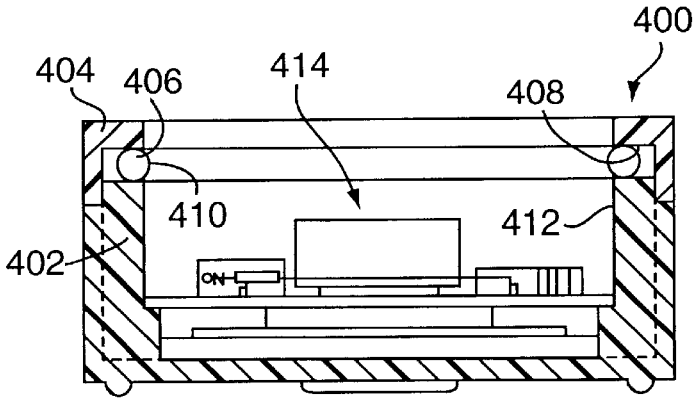
FIG. 13 is a cross-sectional, side elevational view of the present invention.

A third embodiment of the present invention is illustrated in FIG. 11. The present invention device (200) is essentially similar to that described with respect to FIG. 1, except that instead of having a microphone hole for directly delivering audible messages from the physician or pharmacist directly into the microphone element (58), an electrical input jack (202) is provided. The electrical jack (202) can receive a plug that is connected to a microphone, a recorded medium player, a data storage device, or similar means for delivering sound data into the circuitry of the device (200) for processing and delivery as an audible message through the speaker holes (204). Thus, in one instance, a physician or pharmacist may use a microphone that can be attached to the device (200) only when it is necessary to deliver verbal instructions. In another instance, a source of delivering an audible message, such as a machine or a person, may deliver verbal instructions into one recording machine in order to later transfer the message to a device (200) according to the present invention by using an electrical connector through the jack (202). In yet another instance, illustrated in FIG. 12, a sound source (300), such as a person or a machine, may remotely produce an audible message that is recorded by a machine (302) and subsequently transmitted to a remote location where it can be received by another machine (304) and input into a device (200) according to the present invention for use as described above. In this instance, the recorded message may be sent physically on a recording medium, or it may be sent electronically. For example, the recorded message may be converted to digital signals and sent to a remote location via modem or RF.

A fourth embodiment of the present invention is directed to a device (400) similar to that described with respect to the third embodiment, but including additional retaining means for retaining a medication container in the housing of the device (400). The retaining means are, preferably, in the form of a retaining spring (406) that may be a metallic spring in the form of a loop, or a rubber ring, or the like. The rubber ring and the housing in which it is contained may be dimensioned so that the ring is compressed between the housing and a medication container where the device is attached to the container. The device (400) may be constructed with separate internal wall components (402, 404) to form a channel (408) for entrapping and holding the spring (406) relative to the device (400). Alternatively, the channel (408) may be molded into the inner wall (412). When a medication container is received in the device (400), the outer circumferential wall of the container contacts the inner surface (410) of the spring (406) which protrudes past the inner wall (412), thereby causing the spring (406) to compress and exert a resilient retaining force on the container. In a manner similar to that described above with respect to the previous embodiments, various components (414) are stored in the device (400).

While the preferred embodiments have been herein described, it is acknowledged that variation and modification may be made without departing from the scope of the presently claimed invention.

What is claimed is:

1. An audio device for recording and playing audible signals relating to medication contained within a medication container having a cylindrical container body including open and dosed end portions, a generally cylindrical cap, and securing means for releasably retaining the cap on the body to provide a removable closure for sealing the open end portion, said audio device comprising:

a hollow housing closed at one end and having a generally cylindrical opening at its opposite end sized to coaxially receive an associated end portion of the capped medication container therethrough data input means fixed to said body for inputting sound data; data storage means contained in said housing for storage said sound data;

processing means contained in said body for processing said sound data into said audible signals;

sound emitting means fixed to said body for delivering said audible signals into an environment surrounding said device; and attaching means for releasably securing said audio device in assembly with the medication container and including retaining means carried by said housing and projecting generally radially inwardly beyond said generally cylindrical opening for engaging the associated end portion of the medication container when the associated portion of the medicated container is inserted into said opening and forced through said retaining means.

2. An audio device according to claim 1, further comprising control means contained in said housing for selectively operating said data input means and inaccessible when said audio device is assembled with said medication container.

3. A device according to claim 2, further comprising timer means associated with said control means for selectively timing the operation of said sound emitting means.

4. A device according to claim 2, further comprising display means for displaying information relating to the operation of said device.

5. A device according to claim 1, wherein said data input means comprise a microphone.

6. A device according to claim 1, wherein said data input means comprise an electronic connector jack.

7. A device according to claim 1, wherein said sound emitting means comprise a speaker.

8. A device according to claim 1, further comprising at least one hole in said body associated with said data input means to facilitate input of said sound data into said data storage means.

9. A device according to claim 1, further comprising at least one hole in said body associated with said sound emitting means for directing said audible signals from said device into said environment.

10. A device according to claim 1 wherein said retaining means comprises a flexible ring positioned inside said housing open end and adapted to compress between said housing and said container is received in said housing.

11. An audio device as set forth in claim 1 wherein said attaching means comprises a plurality of flexible teeth formed on said housing and projection inwardly beyond said opening.

12. An audio device as set forth in claim 11 wherein the cap has an annular surface extending around the container body and facing in the direction of the closed end and said teeth engage the annular surface to secure said audio device in assembly with the medication container.

13. An audio device as set forth in claim 11 wherein said teeth are formed on said housing at said opening.

14. An audio device for a medication container having a container body including an open end and a closed end, a cap, and securing means for releasably retaining the cap on the body to provide a removable closure for the open end, said audio device comprising:

a hollow housing dosed at one end and having an opening at its opposite end;

data input means contained within said housing for inputting sound data;

data storage means contained within said housing for storing said sound data;

processing means contained within said housing for processing said sound data into audible signals, sound emitting means contained within said housing for delivering said audible signals into an environment surrounding said device, and attaching means for releasably retaining said audio device in assembly with the medication container with a portion of the dosed end of the container disposed within said housing and including a resilient annular retaining member entrapped within an annual channel formed in and opening into the interial of said housing and having an inner surface portion protruding inwardly beyond said opening before assembly of said device with the medication container, said inner surface portion grippingly engaging an associated part of the closed end portion of the container and releasably retaining said audio device in assembly with the medication container in response to insertion of the closed end portion of the container through said opening into said housing and forcibly beyond said retaining member.

15. An audio device for a medication container as set forth in claim 14 wherein said retaining member comprises a spring.

16. An audio device for a medication container as set forth in claim 15 wherein said container has a generally cylindrical body, said opening comprises a generally cylindrical opening generally complementing an associated portion of said container body and said spring comprises a metallic loop.

17. An audio device for a medication container having a generally cylindrical body including an open end and a closed end, a generally cylindrical container cap having a generally radically disposed annular surface, and securing means for releasable retaining the container cap on the container body with the annular surface encircling the container body, facing in the direction of the closed end, and forming a closure for sealing the open end, said audio device comprising:

a hollow housing dosed at one end and having a cylindrical opening at its opposite end sized to receive the container cap therethrough;

data input means fixed to said housing for inputting sound data, data storage means contained within said housing for storing sound data, processing means within said housing for processing said sound data in audible signals;

sound emitting means fixed to said housing for broadcasting said audible signals into an environment surrounding said device; and attaching means for releasably connecting said audio device to the medication container and including a plurality of flexible teeth formed on said housing at said cylindrical opening and projecting generally radially inwardly from said opening, said teeth flexing out of the path of said container cap in response to forcible insertion of the container cap through said opening and into said housing, said teeth engaging said annular surface to releasably retain said audio device in connected assembly with the medication container when the container cap is disposed within said housing.

* * * * *

UNITED STATES PATENT AND TRADEMARK OFFICE

CERTIFICATE OF CORRECTION

PATENT NO. : 6,259,794 B1
DATED : July 10, 2001
INVENTOR(S) : John C. Dobbins

It is certified that error appears in the above-identified patent and that said Letters Patent is hereby corrected as shown below:

Column 6,
Lines 37, 40 and 42, change “body” to -- housing --.

Signed and Sealed this

Ninth Day of September, 2003

JAMES E. ROGAN
*Director of the United States Patent and Trademark Office*